US007477867B2

(12) United States Patent
Hiraoka et al.

(10) Patent No.: US 7,477,867 B2
(45) Date of Patent: Jan. 13, 2009

(54) FIXING DEVICE HAVING CLEANER AND TEMPERATURE DETECTOR

(75) Inventors: Chikara Hiraoka, Hitachi (JP); Toru Hanashima, Hitachi (JP); Masahiko Saito, Hitachi (JP); Shunichi Oohara, Hitachinaka (JP); Toshio Ogiso, Hitachi (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 302 days.

(21) Appl. No.: 11/201,226

(22) Filed: Aug. 11, 2005

(65) Prior Publication Data

US 2006/0034646 A1 Feb. 16, 2006

(30) Foreign Application Priority Data

Aug. 11, 2004 (JP) ..... 2004-234251

(51) Int. Cl.
*G03G 15/20* (2006.01)

(52) U.S. Cl. ..... 399/327

(58) Field of Classification Search ..... 399/67–70, 399/326, 327, 329, 330, 331; 219/216
See application file for complete search history.

(56) References Cited

U.S. PATENT DOCUMENTS 4,711,549 A * 12/1987 Roodbeen ..... 399/308
5,621,512 A 4/1997 Uehara et al.
2003/0016963 A1* 1/2003 Yoshinaga et al. ..... 399/69

FOREIGN PATENT DOCUMENTS

| | | | |
|---|---|---|---|
| DE | 1957728 A | * | 6/1970 |
| JP | 04174885 A | * | 6/1992 |
| JP | 05-150679 | | 6/1993 |
| JP | 06075498 A | * | 3/1994 |
| JP | 08227247 A | * | 9/1996 |
| JP | 2000181267 A | * | 6/2000 |
| JP | 2002189375 A | * | 7/2002 |
| JP | 2003-098899 | | 4/2003 |
| JP | 2004-029610 | | 1/2004 |

* cited by examiner

*Primary Examiner*—Robert Beatty
(74) *Attorney, Agent, or Firm*—Antonelli, Terry, Stout & Kraus, LLP.

(57) ABSTRACT

To accomplish high-speed fixing which requires high-precision temperature control, or fixing of high-quality color images on various kinds of paper without increasing the size and production cost of the temperature detecting means and contaminating the back sides of paper by toner that comes off from the temperature detecting element, an image forming device is equipped with a fixing device comprising a heating roller, a pressing belt which forcibly contacts the heating roller, and a temperature detecting means which touches the surface of the heating roller to sense the surface temperature of the heating roller, wherein a cleaning means to clean the belt surface is provided on a place which is corresponding to a place at which the contact-type thermistor touches the heating roller.

17 Claims, 4 Drawing Sheets

FIXING DEVICE HAVING CLEANER AND TEMPERATURE DETECTOR

BACKGROUND OF THE INVENTION

This invention relates to an image forming device such as a copying machine and a printer and more particularly to an image forming device equipped with a fixing device which comprises a temperature detecting means which is in contact with the surface of a heating roller to detect its temperature.

Generally, a fixing device of an image forming device is equipped with a means to detect the surface temperature of a heating roller to keep the surface temperature at a preset value. There are two types of temperature detecting means: contact-type temperature detecting means which is in contact with the surface of a heating roller to detect the temperature of the surface and non-contact-type temperature detecting means which detects the temperature of the surface without touching the roller surface.

Concerning the contact-type temperature detecting means, a temperature detecting means such as a thermistor touches the surface of a heating roller and consequently will be covered with offset toner from the heating roller. The offset toner will come off from the temperature detecting means and smudge recording paper.

To solve such a problem, the contact-type temperature detecting means is usually provided in a non-paper-path area which is outside a paper path section where paper touches the heating roller.

Meanwhile, there are two types of non-contact-type temperature detecting means: type to detect infrared rays as temperature and type to detect radiant heat as temperature. A non-contact-type temperature detecting means unlike the contact-type can be provided in the paper path section of the heating roller.

One example of the above-mentioned prior art is disclosed in the Japanese Application Patent Laid-Open Publication No. 2003-98899.

BRIEF SUMMARY OF THE INVENTION

Since both conventional contact and non-contact temperature detecting methods indirectly detect temperature of a paper path area where recording paper touches a heating roller, their temperature responses are limited. Therefore, these temperature detecting methods cannot are not appropriate for high-speed fixing which requires high-precision temperature control, or for fixing of high-quality color images on various kinds of paper such as thin paper (60 to 210 g/m$^2$ as basic weight), cardboards, envelopes, and OHP sheets that require adequate temperature control during fixing. This is because of the following:

First, in the contact-type temperature detecting method which uses a contact type thermistor provided in the non-paper path area of the end of the heating roller, heat does not transfer fast along the axis of the heating roller. This means that the paper-path area of the heating roller (which touches paper to melt toner on paper) is cooled fast by paper when it touches the paper but that the non-paper path area at respective ends of the heating roller is not cooled so fast. As the result, the temperature detected by the contact-type thermistor is different from the surface temperature of the heating roller and it is difficult to keep the surface temperature of the heating roller at a preset value.

Further, when the surface temperature of the heating roller must be changed according to various kinds of paper, temperature detection by the contact type thermistor (provided in the non-paper path area) is not enough to control the temperature of the paper-path section of the heating roller accurately.

Contrarily, in the non-contact type temperature detecting method, the temperature detecting means does not touch the heating roller and can be provided in the paper path section of the heating roller. Therefore, this type of temperature detecting means unlike the contact-type temperature detecting means can detect the temperature of the paper-path section more effectively than the contact-type temperature detecting means. Nevertheless, the infrared ray type and the radiant ray type have problems below.

The infrared ray type temperature detecting means requires a protective member to protect the detecting means against thermal influences due to air flow or fluctuation near the detecting means. This makes the infrared ray type temperature detecting means (particularly the thermistor section) much greater than the contact-type and radiant ray type temperature detecting means, and increases the number of parts and the product cost.

The radiant ray type temperature detecting means uses the same detecting element as the contact-type temperature detecting means (or thermistor) but detects the surface temperature of the heating roller through an air layer between the temperature detecting means and the surface of the heating roller. Therefore, its structure is simple and most effective to decrease its dimensions and cost. However, since this temperature detection is carried out via an air layer, there generates a difference between the surface temperature of the heating roller and the temperature detected by the detecting means (due to a time lag in heat transfer). Consequently, as well as in the contact-type temperature detection, the temperature of the heating roller is not stable in high-speed fixing and high-quality color image fixing on various kinds of paper. In an extreme case, paper entwining or jam may occur.

This invention relates to an image forming device equipped with a fixing device comprising a heating roller, a pressing belt which forcibly contacts the heating roller, and a temperature detecting means which touches the surface of the heating roller to sense the surface temperature of the heating roller, wherein a cleaning means is provided between the heating roller and the temperature detecting means to clean the belt surface where the temperature detecting means touches.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only. In the drawings.

DETAILED DESCRIPTION OF THE INVENTION

This invention can accomplish high-speed fixing which requires high-precision temperature control, or fixing of high-quality color images on various kinds of paper without increasing the size and production cost of the temperature detecting means and contaminating the back sides of paper by toner that comes off from the temperature detecting element.

Figure 1:
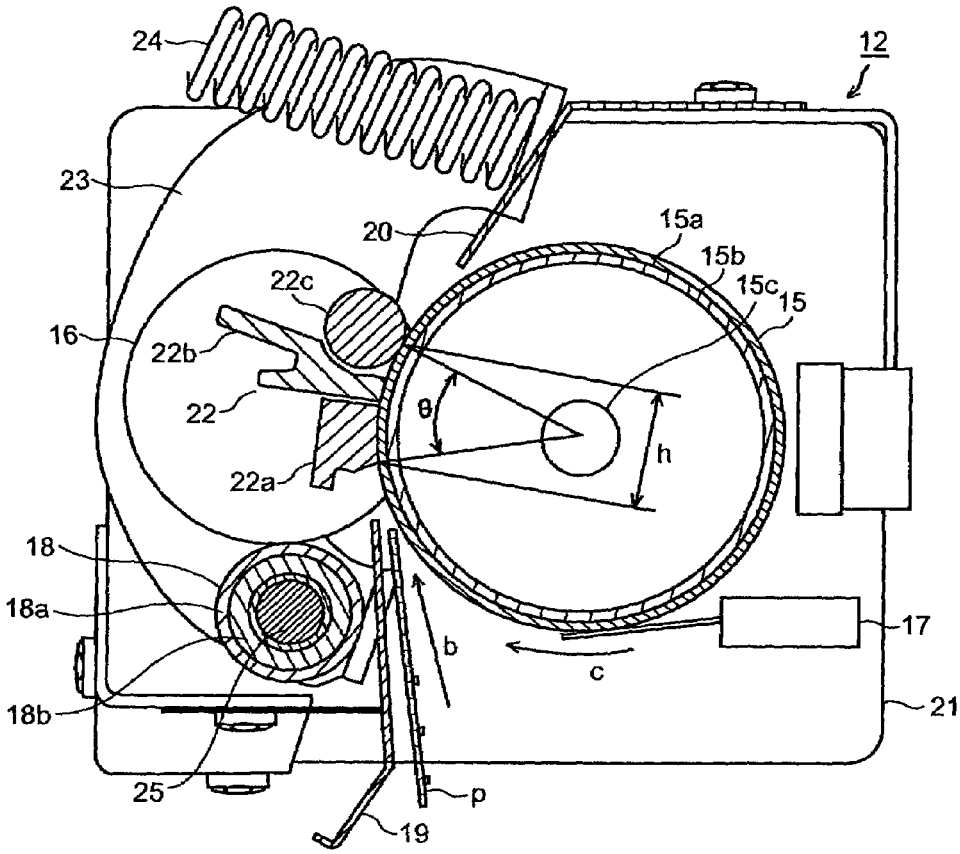
FIG. 1 shows a schematic configuration of the fixing device in accordance with this invention.
Figure 2:
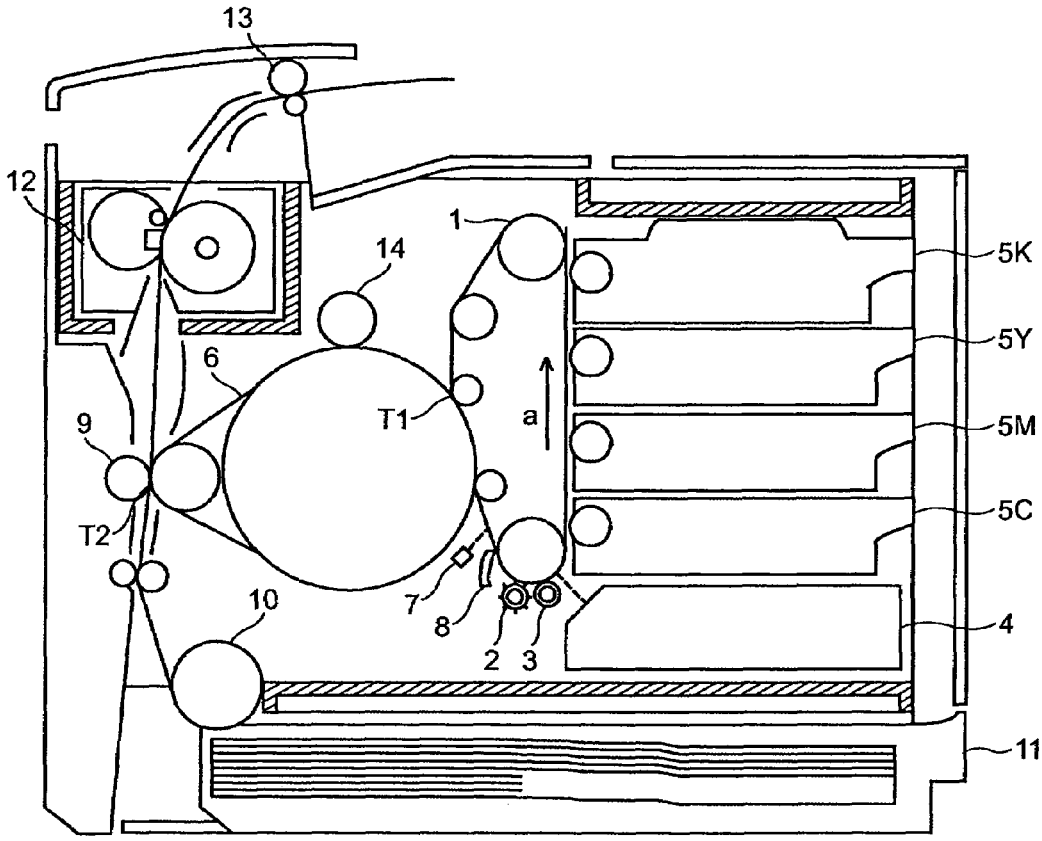
FIG. 2 shows a schematic configuration of the image forming device in accordance with this invention.

Other objects and advantages of this invention will become apparent from the following description of embodiments with reference to the accompanying drawings in which:

Referring to FIG. 2, first will be explained the entire configuration of an image forming device which is an embodiment of this invention. In FIG. 1, photoconductor belt 1 is supported in the image forming device so as to move endlessly in the direction of arrow "a." Charging brush 2 and charging roller 3 are provided in contact with the surface of photoconductor belt 1 to give an even charge to the surface of photoconductor belt 1. Exposing device 4 to apply light to the surface of photoconductor belt 1 exposes the evenly-charged surface of photoconductor belt 1 dot by dot to form an electrostatic latent image on the belt according to image and character information sent from a personal computer or image scanner.

The electrostatic latent image formed on the photoconductor belt 1 are made visible with toner supplied from one of developers (5K, 5Y, 5M and 5C) and moved to first transfer position T1. At this position (T1), the toner image is transferred from the photoconductor belt (1) to the surface of intermediate transfer member 6 by a potential difference between photoconductor belt (1) and intermediate transfer member 6.

After passing through the first transfer position (T1), the photoconductor belt (1) receives light from residual image remover 7. This reduces the face potential of the belt (1) below a preset potential and the latent image disappears from the belt surface. Next, cleaning device 8 scrapes off toner which still remains on the conductor belt (1) after transferring. Now the conductor belt (1) is ready to form a next image.

The above steps are repeated to form color images of black, yellow, magenta, and cyan. Finally, a color toner image which satisfies the image and character information is formed on the surface of the intermediate transfer member (6).

The toner image on the intermediate transfer member (6) is transferred to a recording medium supplied from medium cassette 11 by recording medium supplying device 10. After image transfer, the recording medium is separated from the intermediate transfer member (6), fed to fixing device 12 to fix the toner image to the recording medium, and then ejected to the outside of the image forming device by medium ejecting device 13.

In FIG. 2, cleaning device 14 cleans the surface of the intermediate transfer member (6).

Referring to FIG. 1, below will be explained a configuration of the fixing device.

Fixing device 12 comprises heating roller 15, pressing belt 16, contact-type thermistor, 17 which is a temperature detecting means, cleaner 18, separation guide 20, and side plate 21.

Recording medium P having an unfixed toner image on it is fed into the fixing device (12) as indicated by arrow "b." The toner image is molten and fixed to the recording medium (P) in the fixing device (12). The fixed recording medium (P) is separated from the heating roller (15) by the separation guide (20) and ejected from the fixing device (12).

Heating roller 15 is an elastic roller of 40.4 mm in outer diameter which comprises aluminum cylinder 15*a* of 1 mm thick coated with 0.8 mm-thick silicone rubber layer 15*b* (JIS hardness 20). The outer surface of the elastic roller is further coated with a 30 μm-thick PFA (tetrafluoroethylene perfluoroalkylvinyl ether copolymer) to assure separation of toner from the roller surface. The heating roller (15) contains heater 15*c* to melt toner on the surface of the roller. The heating roller (15) is pivotally supported by side plate 21 and driven to rotate in the direction of arrow "c" by gears (not shown in FIG. 1).

The pressing belt (16) is a seamless polyimide belt of 80 μm thick by 30 mm in inner diameter and its surface is coated with a 30 μm-thick PFA layer to assure separation of toner from the roller surface. The pressing belt (16) is engaged with pressing means 22 which comprises pressing members (22*a* and 22*b*) and pressing roller 22*c*. Pressing arm 23 and pressing spring 24 are provided to make the heating roller (15) touch the heating roller surface of preset angle θ to melt toner there (contact area "h").

Contact-type thermistor 17 touches the paper-path section of the heating roller (15) to detect the surface temperature of the heating roller (15) accurately for control heat generation of heater 15*c*. Therefore, this can directly detect the temperature of the paper-path section of the heating roller (15). Its heat response is very quick and high-precision temperature control can be accomplished. This invention uses, for example, board sensor PM7S-342 (fabricated by Shibaura Electronics Corp.) as the contact-type thermistor.

Cleaner 18 comprises cleaning member 18*a* which touches the pressing belt 16 to remove toner or paper dust and base 18*b* which is pivotally supported by stationary shaft 25 so that the cleaner (18) may be driven to rotate when the pressing belt (16) moves. In summary, the cleaner (18) removes toner and paper dust from the pressing belt (16) and prevents them from contaminating the paper.

Cleaning member 18*a* is made of a fiber material which is heat-resistant, elastic, and effective to retain toner or paper dust and particularly the cleaning member (18*a*) is a non-woven polyamide cloth or artificial leather made of very fine polyester fiber and polyurethane. This invention uses Toray artificial leather K10010D because of the following:

Generally, non-woven cloth of polyimide fiber is used as a cleaning material. However, artificial leather has a good surface smoothness because it is made of fine fiber and can make the surface evener than the non-woven cloth of polyimide fiber when it touches the pressing belt (16). Further, the cleaning material has a good affinity to toners because cleaning materials and toners are mainly made of polyester resin. Consequently, artificial leather has a longer toner retaining ability than polyamide fiber.

Base material 18*b* is heat-resistant, abrasion-resistant, and capable of sliding on the stationary shaft (25). The base material (18*b*) of this invention is made of, for example, PPS resin and the surface in contact with the stationary shaft (25) is coated with a fluorine anti-friction material.

Next will be explained a positional relationship between the contact-type thermistor (17) and the cleaner (18).

Figure 3:
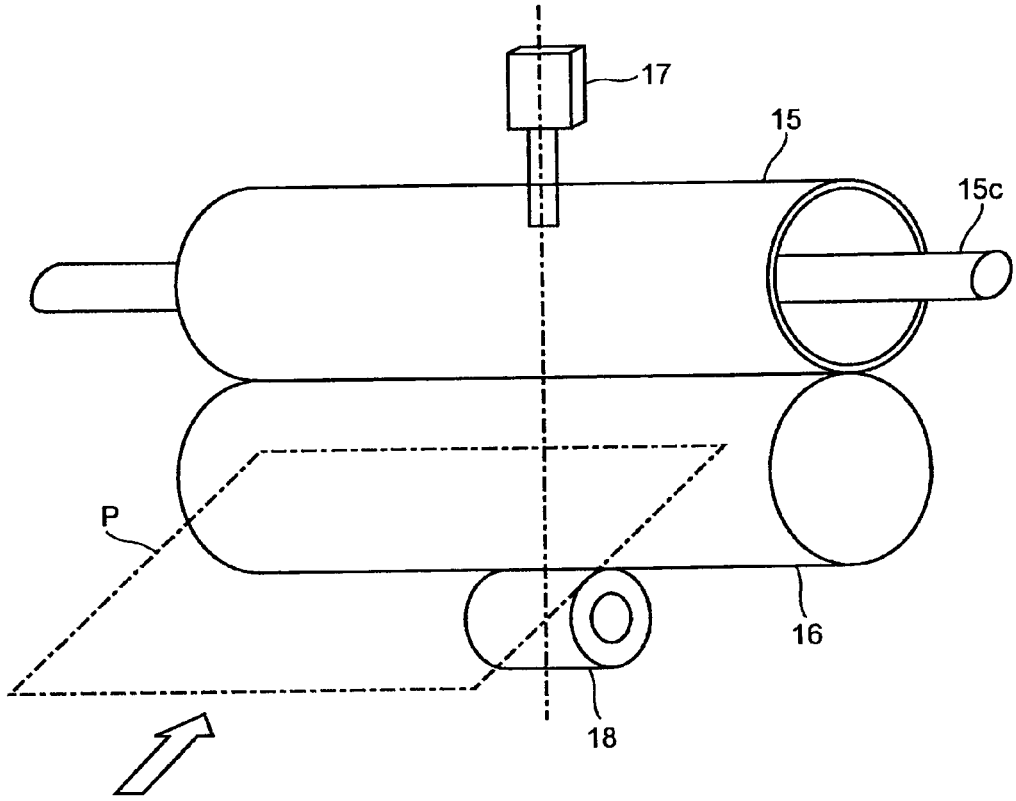
FIG. 3 is a schematic configuration showing a positional relationship between the contact-type thermistor (17) and the cleaner (18).

FIG. 3 shows a diagrammatic longitudinal drawing of a fixing device in accordance with this invention which shows a positional relationship of heating roller 15, pressing belt 16, contact type thermistor 17, and cleaner 18. The contact type thermistor (17) touches the paper-path section of the heating roller (15) which contains heater 15*c*. Therefore, this can directly detect the temperature of the paper-path section of the heating roller (15). Its heat response is very quick and high-precision temperature control can be accomplished. However, as printing advances, the contact type thermistor (17) is gradually covered with offset toner and paper dust that come from the heating roller (15) and comes off to the surface of the heating roller (15). As the heating roller (15) revolves, the fallen lump of toner and dust is carried towards the pressing belt 16 and stains the back side of paper P. Such a symptom is often recognized when cardboards are printed in a wrong print mode (e.g. Thin Paper mode), when two or more paper sheets are delivered at a time, or when a paper jam occurs. In such as case, excessive offset toner is supplied and finally a big lump of toner will fall to contaminate paper P.

To remove toner and paper dust from the pressing belt (16) and prevent the back side of paper from being contaminated, this invention provides cleaner 18 contacting the pressing belt (16) at a width position of the pressing belt (16) which corresponds (i.e., correlates) in position to a width position of the heating roller (15) at which the contact-type thermistor (17) touches the heating roller (15). Although the cleaner (18) of this invention is a little wider than the contact-type thermistor (17) to reduce the production cost, the cleaner (18) can be wide enough to touch the entire length of the pressing belt (16).

Figure 4:
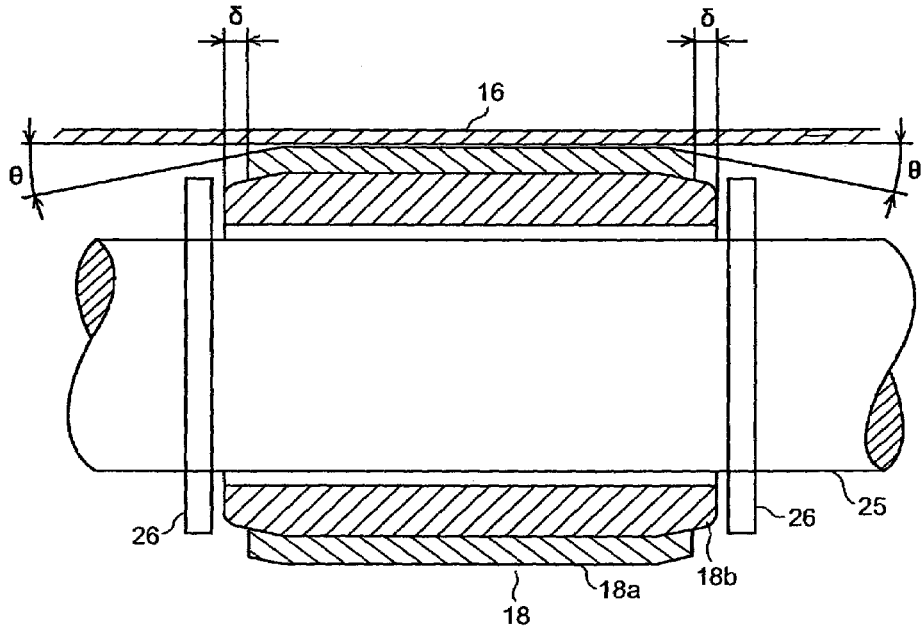
FIG. 4 is an enlarged view of details of the cleaner in accordance with this invention.

Next will be explained the shape of the cleaner in accordance with this invention and how the cleaner touches the surface of the pressing belt with reference to FIG. 4. FIG. 4 shows enlarged cross-section diagrams of the cleaner (18) and the pressing belt (16).

The cleaner (18) is inserted into stationary shaft 25 and its position is determined by washers 26. Each end of cleaner base 18*b* is tapered outwards at a preset angle (θ) to the pressing belt (16) so that both ends of the cleaning member (18*a*) may not touch the pressing belt (16). This is because the end edges of the cleaning member (18*a*) may damage the surface of the pressing belt (16) if the edges touch the pressing belt (16) and this may cause image failures.

Further, the cleaning member (18*a*) is made shorter by δ than the cleaner base (18*b*) to prevent extrusion of the ends of the cleaning member (18*a*). In other words, if the cleaning member (18*a*) runs off the edges of the base (18*b*), the protruding cleaning member (18*a*) touches the washer (26) and prevents the cleaner (18) from rotating due to a frictional load. As the result, the cleaning member (18*a*) is dragged by the pressing belt (16) and damages the surface of the belt (16) or the cleaning member (18*a*) may be pulled away from the base (18*b*).

This cleaner configuration prevents the cleaner from damaging the pressing belt and consequently has an effect to prolong the service life of the fixing device.

Figure 5:
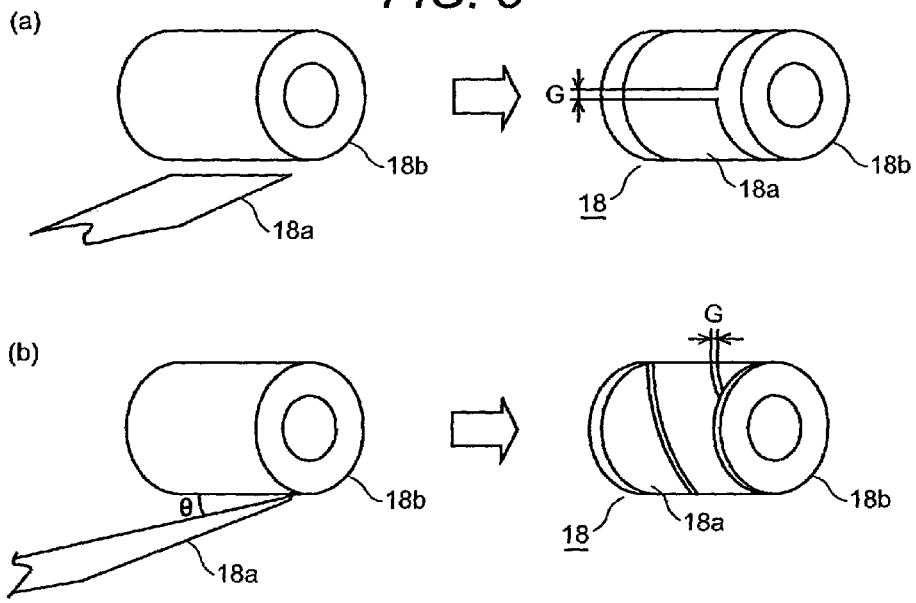
FIG. 5 shows configurations of cleaners in accordance with this invention.

Next will be explained a shape of the cleaning member in accordance with this invention, referring to FIG. 5. A heat-resistant adhesive or double-sided adhesive tape is used to bond the cleaning member (18*a*) to the cleaner base (18*b*). The cleaner (18) has the cleaning member (18*a*) wound around the cleaner base (18*b*). FIG. 5(*a*) shows that the cleaning member (18*a*) is wound around the cleaner base (18*b*) with the leading and trailing edges of the member (18*a*) butted together. FIG. 5(*b*) shows that the cleaning member (18*a*) is wound around the cleaner base (18*b*) at a preset angle (θ) to the edges of the cleaner base (18*b*).

When the cleaning member (18*a*) is wound around the cleaner base (18*b*) with the leading and trailing edges of the member (18*a*) butted together, the butting seam (G) is along the axis of the cleaner (18) or perpendicular to the rotational direction of the cleaner. Therefore, the cleaner stops rotating when the butting seam (G) breaks. As the result, the cleaning member (18*a*) is dragged by the pressing belt (16) and damages the surface of the belt (16) or the cleaning member (18*a*) may be pulled away from the base (18*b*). If the cleaning member (18*a*) is made of artificial leather of very fine polyester fiber and polyurethane, the cleaning member (18*a*) shrinks by heat and widens the butting seam (G). Therefore, it increases the possibility of damaging the pressing belt (16) and separating the cleaning member from the base.

Contrarily, when the cleaning member (18*a*) is spirally wound around the cleaner base (18*b*), the butting seam is at an angle (θ) to the rotational direction of the cleaner 18. This causes little rotational load. Further, when the cleaning member (18*a*) shrinks by heat, the butting seam (G) becomes narrower. Consequently, the cleaner (18) can rotate steadily.

As explained above, this invention is characterized by winding the cleaning member (18*a*) spirally around the cleaner base (18*b*). This can stabilize the rotation of the cleaner (18), remove toner and paper dust from the pressing belt, and finally prolong the service life of the fixing device.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A fixing device comprising:

a heating roller, a pressing belt which forcibly contacts the heating roller, a temperature detecting means which touches a surface of the heating roller at a predetermined width position of the heating roller to sense the surface temperature of the heating roller, and a cleaning means contacting the pressing belt to clean a belt surface thereof, where the cleaning means is provided at a predetermined width position of the pressing belt corresponding in position to the predetermined width position of the heating roller where the temperature detecting means touches the surface of the heating roller, and the cleaning means is configured to be driven by the pressing belt.

2. The fixing device of claim 1, wherein said cleaning means comprises a base material made of a heat-resistant resin and artificial leather which is spirally wound around the surface of the base material.

3. The fixing device of claim 2, wherein said artificial leather is made of polyester fiber and polyurethane.

4. The fixing device of claim 3, wherein said polyester fiber is made of very thin polyester fiber.

5. The fixing device of claim 2, wherein each end of the cleaning means tapers to a narrower diameter in comparison to a diameter of said cleaning means at a central width portion of the cleaning means.

6. An image forming device comprising the fixing device of any of claims 1 to 5.

7. The fixing device of claim 1, wherein a width of the cleaning means is a fraction of a width of the pressing belt.

8. The fixing device of claim 1, wherein the cleaning means contacts the pressing belt at a position adjacent to where the pressing belt is fed into contact with the heating roller.

9. A fixing device comprising:

a heating roller, a pressing belt which forcibly contacts the heating roller, a temperature detector configured to touch a surface of the heating roller at a predetermined width position of the heating roller to sense the surface temperature of the heating roller, and a cleaning roller contacting the pressing belt to clean a belt surface thereof, where the cleaning roller is provided at a predetermined width position of the pressing belt corresponding in position to the predetermined width position of the heating roller where the temperature detector touches the surface of the heating roller, and the cleaning roller is configured to be driven by the pressing belt.

10. The fixing device of claim 9, wherein said cleaning roller comprises a base material made of a heat-resistant resin and artificial leather which is spirally wound around the surface of the base material.

11. The fixing device of claim 10, wherein said artificial leather is made of polyester fiber and polyurethane.

12. The fixing device of claim 11, wherein said polyester fiber is made of very thin polyester fiber.

13. The fixing device of claim 10, wherein each end of the cleaning means tapers to a narrower diameter in comparison to a diameter of said cleaning means at a central width portion of the cleaning means.

14. An image forming device comprising the fixing device of any of claims 9 to 13.

15. The fixing device of claim 9, wherein a width of the cleaning roller is a fraction of a width of the pressing belt.

16. The fixing device of claim 9, wherein the cleaning roller contacts the pressing belt at a position adjacent to where the pressing belt is fed into contact with the heating roller.

17. A fixing device comprising:

a heating roller, a pressing belt which forcibly contacts the heating roller, a temperature detecting means which touches a surface of the heating roller at a predetermined width position of the heating roller to sense the surface temperature of the heating roller, and a cleaning means contacting the pressing belt to clean a belt surface thereof, where the cleaning means is provided at a predetermined width position of the pressing belt corresponding in position to the predetermined width position of the heating roller where the temperature detecting means touches the surface of the heating roller.

* * * * *